US005957098A

United States Patent [19]

Fukuhara et al.

[11] Patent Number: 5,957,098

[45] **Date of Patent: *Sep. 28, 1999**

[54] HYDRAULIC VALVE TIMING ADJUSTING APPARATUS

[75] Inventors: Katsuyuki Fukuhara, Kobe; Masafumi Sugawara, Tokyo; Makoto Yamauchi, Tokyo; Chikara Ueno, Tokyo, all of Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/093,310

[22] Filed: Jun. 9, 1998

[30] Foreign Application Priority Data

Jul. 17, 1997 [JP] Japan ..... 9-192538

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,666,914 | 9/1997 | Ushida et al. | 123/90.17 |
| 5,724,929 | 3/1998 | Mikame et al. | 123/90.17 |
| 5,738,056 | 4/1998 | Mikame et al. | 123/90.17 |
| 5,797,361 | 8/1998 | Mikame et al. | 123/90.17 |

FOREIGN PATENT DOCUMENTS

| | | |
|---|---|---|
| 0 799 976 A1 | 10/1997 | European Pat. Off. . |
| 9-250310 | 9/1997 | Japan . |

*Primary Examiner*—Weilun Lo

*Attorney, Agent, or Firm*—Sughrue, Mion, Zinn Macpeak & Seas, PLLC

[57] ABSTRACT

A hydraulic valve timing adjusting apparatus to be provided in a driving force transmission system for transmitting driving force to a camshaft with a cam for opening and closing an intake valve or an exhaust valve, comprising a housing assembly; a rotor provided so as to be relatively rotatable with respect to the housing assembly; hydraulic chambers formed between the rotor and the housing assembly; a convex member provided in one of the housing assembly and the rotor so as to be slidable therein; a recessed portion provided in the other one of the housing assembly and the rotor so as to be engageable with the convex member; an urging member for urging the convex member toward the recessed portion; and an oil passage which is able to supply oil pressure to the recessed portion; wherein when the oil pressure is supplied to one of the hydraulic chambers, the rotor is relatively rotated with respect to the housing assembly, and when the oil pressure is supplied to the recessed portion, the convex member is slidden in a direction opposite to the recessed portion to release engagement between the convex member and the recessed portion.

13 Claims, 12 Drawing Sheets

HYDRAULIC VALVE TIMING ADJUSTING APPARATUS

BACKGROUND OF THE INVENTION

1. Field of the Invention

The present invention relates to a hydraulic valve timing apparatus which adjusts the timing of the opening and closing operation of either or both of an intake valve and an exhaust valve of an internal combustion engine, called the engine later on.

2. Discussion of Background

There has been known that when a camshaft is driven by a timing pulley or a chain sprocket rotating in synchronization with a crankshaft of the engine, a vane type valve timing mechanism can be provided between the timing pulley and the camshaft to relatively rotate the camshaft with respect to the crankshaft, and the rotation of the camshaft with respect to the rotation of the crankshaft is retarded or advanced to shift the operating timing of an intake valve or an exhaust valve with respect to the engine speed so as to reduce exhaust gas or improve fuel consumption, as disclosed in JP-A-192504, JP-A-7238815, JP-A-913920 and so on.

As disclosed in e.g. JP-A-960508, there has also been known that a stopper piston urged by a spring is provided in a vane rotor and a stopper hole which the stopper piston is engaged with is formed in a housing assembly wherein when oil pressure has not reached a predetermined pressure as e.g. just after starting the engine, the stopper piston is engaged with the stopper hole to prevent collision between the housing assembly and a vane, and when the oil pressure has reached the predetermined pressure, partial pressure of the oil pressure which is supplied to a retarding hydraulic chamber or an advancing hydraulic chamber through the vane rotor is used to move the stopper piston for release from the engagement with the stopper hole.

Since the conventional hydraulic valve timing adjusting apparatus as discussed above have the stopper piston and the spring provided in the vane rotor, the stopper piston is required to be housed in the vane rotor, in particular, in a vane so as to be slidable therein, reducing the strength of the vane.

Such arrangement could shift the center of gravity of the vane rotor to deform the vane rotor. If the clearance between the housing and the vane rotor become small in order to improve a sealing property, the vane rotor could contact with the housing.

Because a hydraulic chamber which moves the stopper piston using the oil pressure in the retarding hydraulic chamber and a hydraulic chamber which moves the stopper piston using the advancing hydraulic chamber are independently provided, a wasteful space has been required.

Since the hydraulic chamber which moves the stopper piston using the oil pressure in the retarding hydraulic chamber moves the spring using the difference in pressure receiving area caused by the difference between a large diameter portion and a small diameter portion of the stopper piston, it has been impossible to effectively use the oil pressure for movement of the stopper piston.

SUMMARY OF THE INVENTION

It is an object of the present invention to solve these problems and to provide a hydraulic valve timing adjusting apparatus capable of making the apparatus compact and of carrying out the movement of a stopper piston effectively by oil pressure.

The present invention provides a hydraulic valve timing adjusting apparatus which comprises a convex member provided in one of a housing assembly and a rotor so as to be slidable therein, a recessed portion provided in the other one of the housing assembly and the rotor so as to be engageable with the convex member, and an urging member for urging the convex member toward the recessed portion, wherein when oil pressure is supplied to the recessed portion, the convex member is slidden in a direction opposite to the recessed portion to release engagement between the convex member and the recessed portion.

The present invention also provides a hydraulic valve timing adjusting apparatus which comprises an advancing hydraulic chamber and a retarding hydraulic chamber formed between a rotor and a housing assembly, a convex member provided in one of the housing assembly and the rotor so as to be slidable therein, a recessed portion provided in the other one of the housing assembly and the rotor so as to be engageable with the convex member, an urging member for urging the convex member toward the recessed portion, an oil passage which is able to supply oil pressure to the recessed portion, and a hydraulic switching device provided in the oil passage to supply the oil pressure to either one of the advancing hydraulic chamber and the retarding hydraulic chamber, when the oil pressure switched by the hydraulic switching device is supplied to the recessed portion, the convex member is slidden in a direction opposite to the recessed portion to release engagement between the convex member and the recessed portion.

The housing assembly may have a housing portion recessed therein to slidably house the convex member, and the housing portion may selectively communicate with one of the advancing hydraulic chamber and the retarding hydraulic chamber depending on rotation of the rotor.

The hydraulic switching device is movable in a communicating oil passage communicating between the advancing hydraulic chamber and the retarding hydraulic chamber and in a group in a portion of the communicating oil passage, and the hydraulic switching device may include a slide plate to carry out opening and closing operation of the oil passage for supplying the oil pressure to the recessed portion.

The apparatus according to the present invention may further comprise a seal member for preventing oil from moving between the hydraulic chambers, a leaf spring for urging the seal member toward a seal surface, and a holding member for holding the leaf spring so as to be deformable in a predetermined range.

As explained, a hydraulic valve timing adjusting apparatus according to the present invention comprises the convex member provided in the housing assembly so as to be slidable therein, the recessed portion provided in the rotor so as to be engageable with the convex member, and the urging member for urging the convex member toward the recessed portion, wherein when the oil pressure is supplied to the recessed portion, the convex member is slidden in the direction opposite to the recessed portion to release engagement between the convex member and recessed portion. The provision of the unslidable recessed portion in the rotor can prevent the center of gravity in the rotor from shifting, and the rotor and the housing assembly from contacting each other.

A hydraulic valve timing adjusting apparatus according to the present invention comprises the advancing hydraulic chamber and the retarding hydraulic chamber formed between the rotor and the housing assembly, the convex member provided in one of the housing assembly and the rotor so as to be slidable therein, the recessed portion provided in the other one of the housing assembly and the rotor so as to be engageable with the convex member, the urging member for urging the convex member toward the recessed portion, the oil passage which is able to supply the oil pressure to the recessed portion, and the hydraulic switching device to supply the oil pressure to either one of the advancing hydraulic chamber and the retarding hydraulic chamber, wherein when the oil pressure switched by the hydraulic switching device is supplied to the recessed portion, the convex member is slidden in the direction opposite to the recessed portion to release engagement between the convex member and the recessed portion. In order to slide the convex member, the oil pressure is switched to whichever of the advancing hydraulic chamber and the retarding hydraulic chamber has a larger value of oil pressure therein. The convex member can be ensured to be slidden.

In a preferred mode of the present invention, the housing assembly has the housing portion recessed therein to slidably house the convex member, and the housing portion selectively communicates with one of the advancing hydraulic chamber and the retarding hydraulic chamber depending on rotation of the rotor. The convex member can be held at a suitable position using the oil pressure in the advancing hydraulic chamber or the retarding hydraulic chamber in addition to the oil pressure from the oil passage.

In a preferred mode of the present invention, the hydraulic switching device is movable in the communicating oil passage communicating between the advancing hydraulic chamber and the retarding hydraulic chamber and in the group in the communicating oil passage, and the hydraulic switching device includes the slide plate to carry out opening and closing operation of the oil passage for supplying the oil pressure to the recessed portion. The hydraulic switching device can be provided in a simple structure.

In a preferred mode of the present invention, there are provided the seal member for preventing the oil from moving between the hydraulic chambers, the leaf spring for urging the seal member toward the seal surface, and the holding member for holding the leaf spring so as to be deformable in the predetermined range. Fabrication can be made easily since the leaf spring is prevented from falling out of the seal member during assemblage.

DETAILED DESCRIPTION OF THE PREFERRED EMBODIMENTS

Now, embodiments according to the present invention will be described.

EMBODIMENT 1

Figure 1:
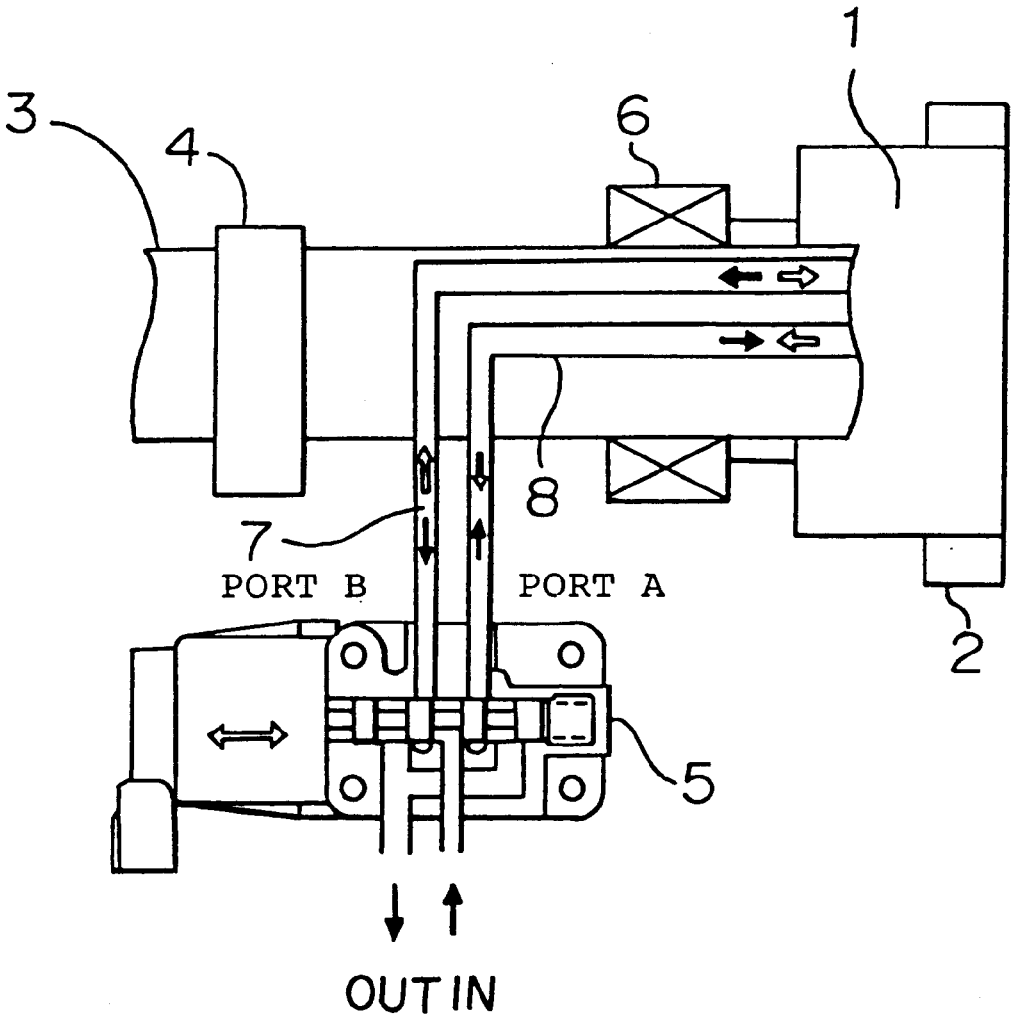
FIG. 1 is a schematic view showing the intake valve timing apparatus and its surroundings according to a first embodiment of the present invention.

In FIG. 1 is shown a schematic diagram of the intake valve timing apparatus and its surroundings according to a first embodiment of the present invention. In this Figure, reference numeral 1 designates a hydraulic actuator which adjusts the timing of an intake valve. Reference numeral 2 designates a pulley on which a timing belt rotated by a crankshaft extends and which is rotated in synchronization with the crankshaft. Reference numeral 3 designates a camshaft which is coupled to the actuator 1 and to which the rotation of the pulley 2 is transmitted so as to be retarded and advanced through the actuator 1. Reference numeral 4 designates a cam which is fixed on the camshaft 3 and rotates together with the camshaft. Reference numeral 5 designates a spool type oil control valve which controls the oil pressure supplied to the actuator 1. The oil control valve 5 has oil supplied thereto from an oil pan opened to atmosphere by an oil pump which carries out pressurization using driven force from the engine. The oil control valve can control the opening and closing operation of two ports A and B and the supply of the oil. Reference numeral 6 designates a bearing which rotatably supports the camshaft 3 and which is fixed to a cylinder head. Reference numeral 7 designates a first oil passage which is formed in the camshaft 3 and a rotor and which communicates with a retarding hydraulic chamber to move the rotor in a retarding direction. Reference numeral 8 designates a second oil passage which is formed in the camshaft 3 and the rotor and which communicates with an advancing hydraulic chamber to move the rotor in an advancing direction.

Figure 2:
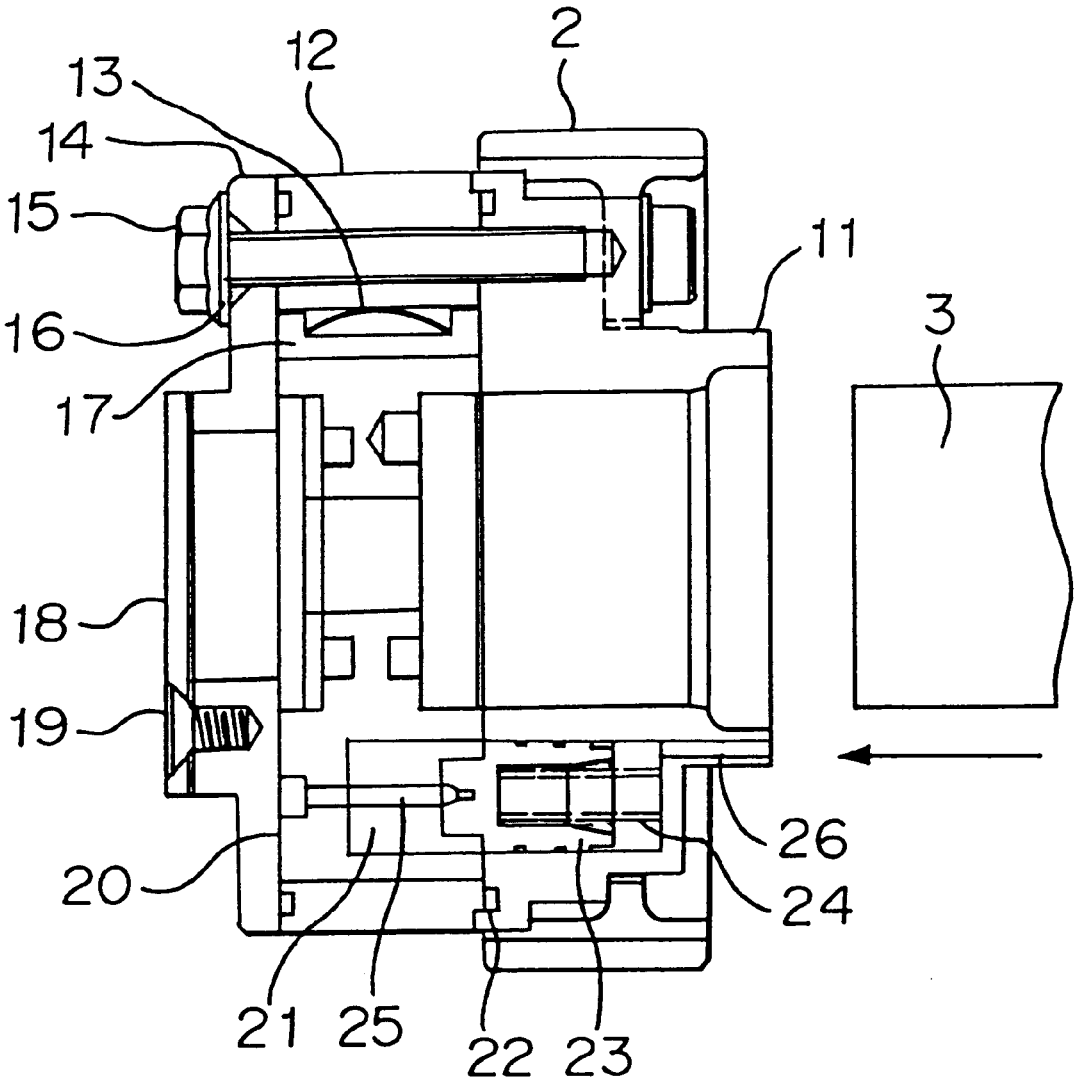
FIG. 2 is a schematic view showing the actuator according to the first embodiment.

In FIG. 2 is shown a schematic view of the actuator 1 according to the first embodiment. In this Figure, reference numeral 11 designates a housing which is arranged so as to be rotatable with respect to the camshaft 3. Reference numeral 12 designates a case which is fixed to the housing 11. Reference numeral 13 designates a back spring which is arranged between a chip seal 17 (explained later) and the case and which comprises a leaf spring to push the chip seal 17 against a rotor 20 (explained later). Reference numeral 15 designates one of bolts which are used the fixing of the housing 11, the case 12 and a cover 14. The housing 11, the case 12 and the cover 14 form a housing assembly. Reference numeral 16 designates one of O-ring which prevents the oil from leaking outside through the gap between a bolt 15 and the bolt hole therefor. Reference numeral 17 designates one of the chip seals which are pushed against the rotor 20 by the back spring 13 and which prevents the oil from moving between hydraulic chambers defined by the rotor 20 and the case 12. Reference numeral 18 designates a plate which is attached to the cover 14. Reference numeral 19 designates a flat head screw which fixes the plate 18 to the cover 14. Reference numeral 20 designates the rotor which is fixed to the camshaft 3 and which is arranged so as to be relatively rotatable with respect to the case 12. Reference numeral 21 designates a cylindrical holder which is provided in the rotor 20 and which has a recess engaged with a plunger 23 (explained later). Reference numeral 22 designates an O-ring which prevents the oil from leaking outside between the housing 11 and the case 12. Reference numeral 23 designates the plunger (lock pin) as a convex member which is slid in the housing 11 by the elastic force of a spring 24 (explained later) and the oil pressure introduced into the holder 21. Reference numeral 24 designates the spring which urges the plunger 23 toward the rotor 20. Reference numeral 25 designates a plunger oil passage which introduces oil pressure so that oil pressure enough to overcome the elastic force by the spring 24 is applied to the plunger 24. Reference numeral 26 designates an air hole which makes the edge of the plunger 23 on the side of the spring 24 open to atmosphere.

Figure 3:
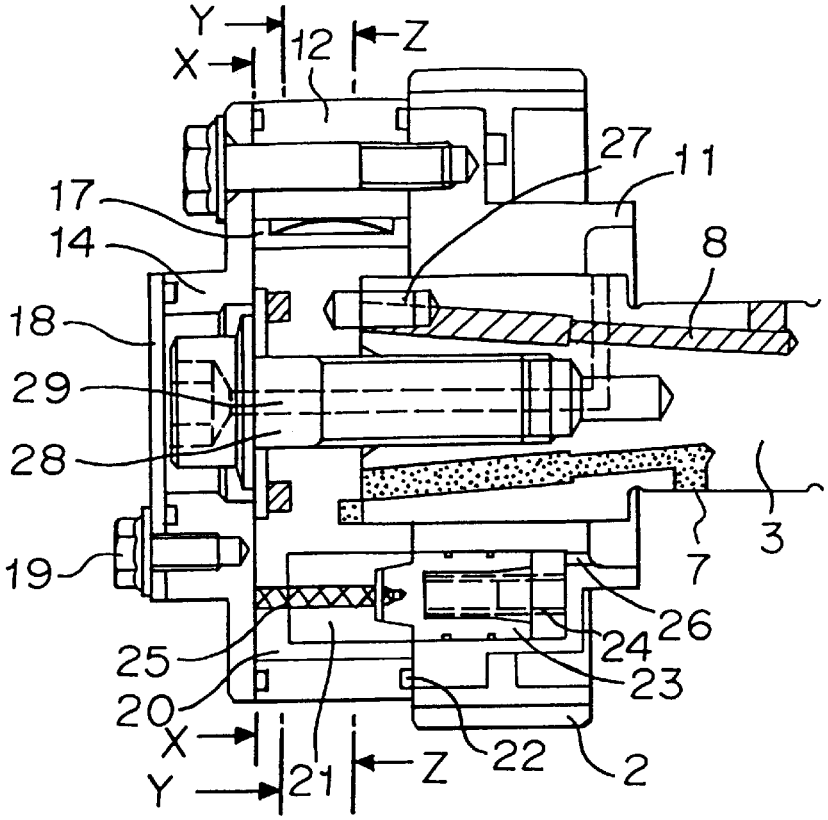
FIG. 3 is a schematic view showing the actuator and the camshaft according to the first embodiment.

In FIG. 3 is shown a schematic view of the actuator 1 and the camshaft 3 according to the first embodiment. In this Figure, reference numeral 27 designates a connecting bolt which connects the camshaft 3 and the rotor 20 for fixing them. Reference numeral 28 designates an axial bolt which connects the camshaft 3 and the rotor 20 for fixing them on the rotational axis thereof. The axial bolt 28 is arranged so as to be rotatable with respect to the cover 14. Reference numeral 29 designates an air hole which is formed in the axial bolt 28 and the camshaft 3 to make the pressure on the inner side of the plate 18 equal to atmospheric pressure.

Figure 4:
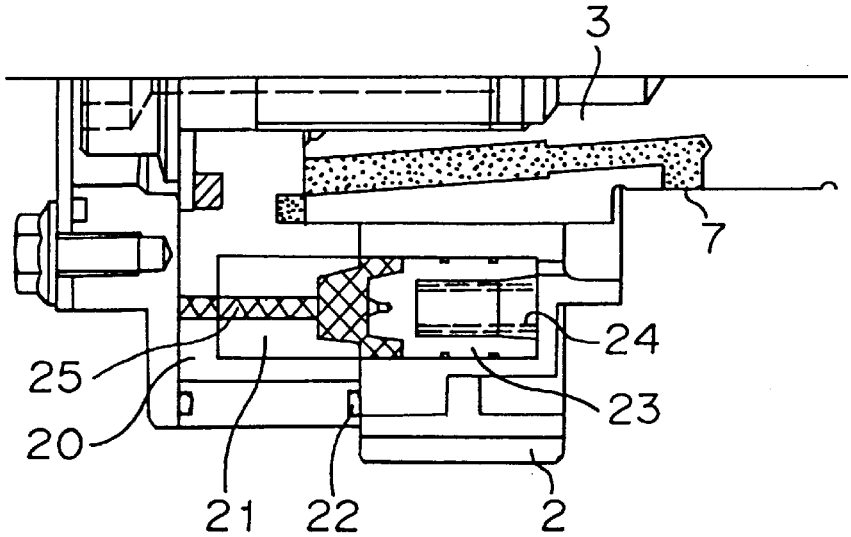
FIG. 4 is a schematic view showing a state wherein oil pressure is applied to a plunger through a plunger oil passage according to the first embodiment.

In FIG. 4 is shown a schematic view of a state wherein the oil pressure is applied to the plunger 23 through the plunger oil passage 25. As shown, the plunger 23 is pushed toward the housing 11 by the oil pressure, compressing the spring 24. As a result, the plunger 23 is disengaged from the holder 21, allowing the rotor 20 to be rotatable with respect to the housing 11.

Figure 5:
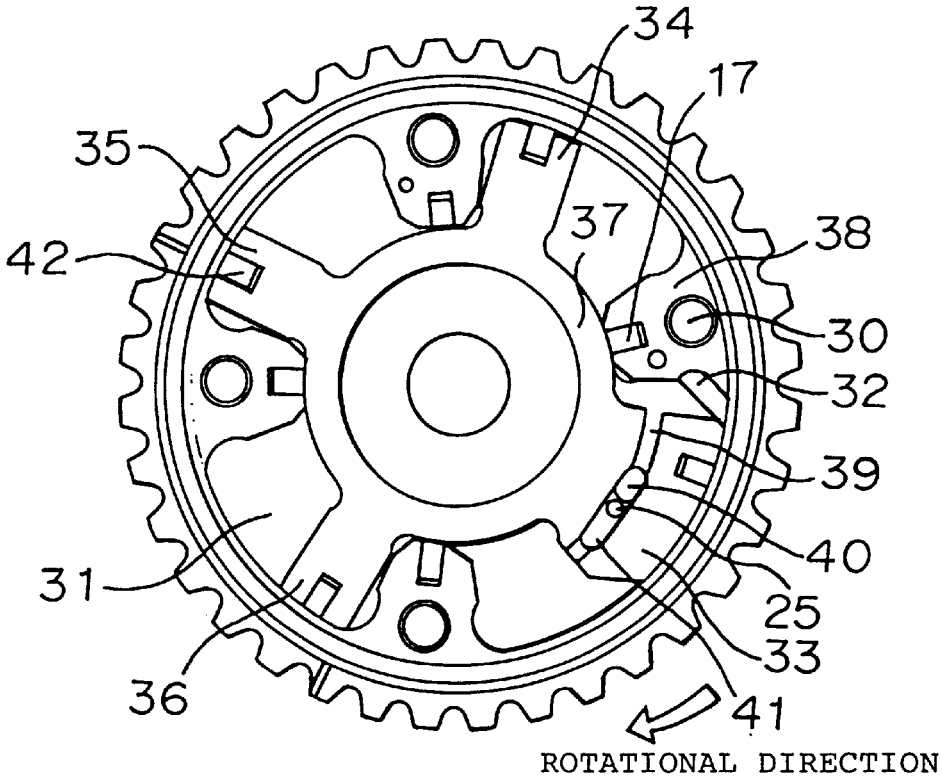
FIG. 5 is a schematic sectional view taken along X—X of FIG. 3 seen from an arrowed direction.
Figure 6:
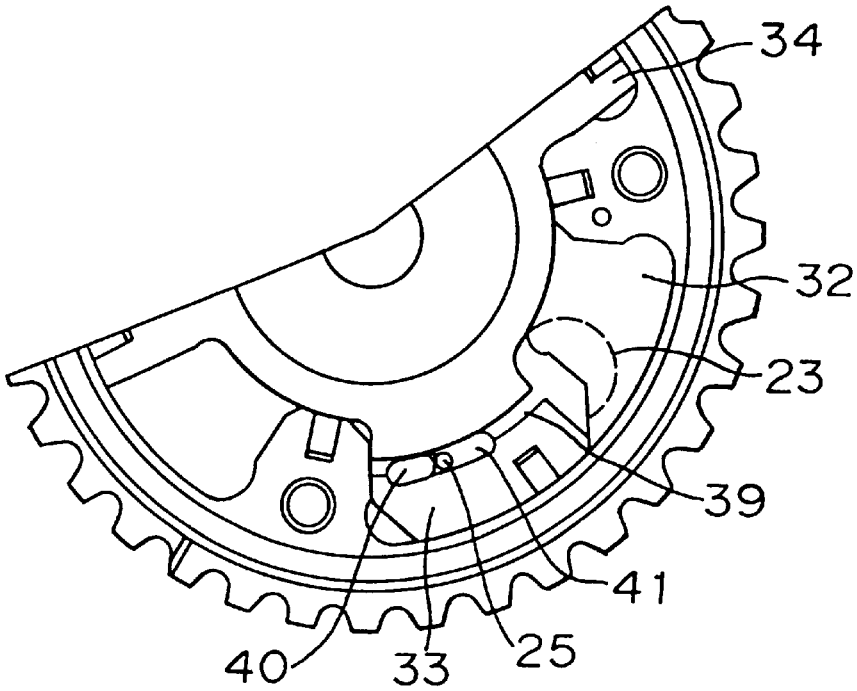
FIG. 6 is a schematic sectional view showing how a slide plate moves in the first embodiment.
Figure 7:
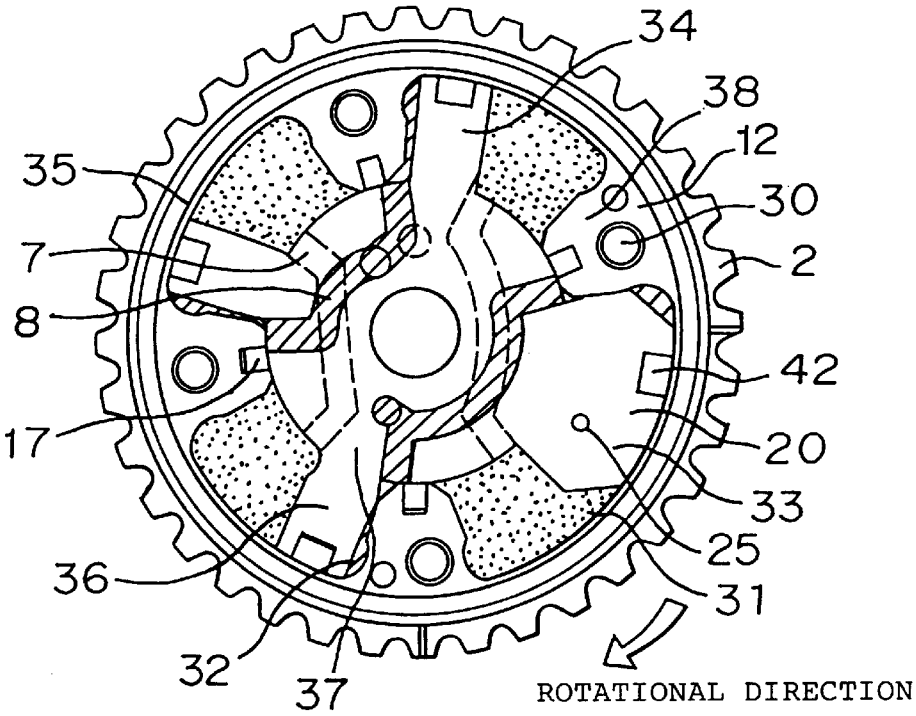
FIG. 7 is a schematic sectional view taken along Y—Y of FIG. 3 seen from an arrowed direction.
Figure 8:
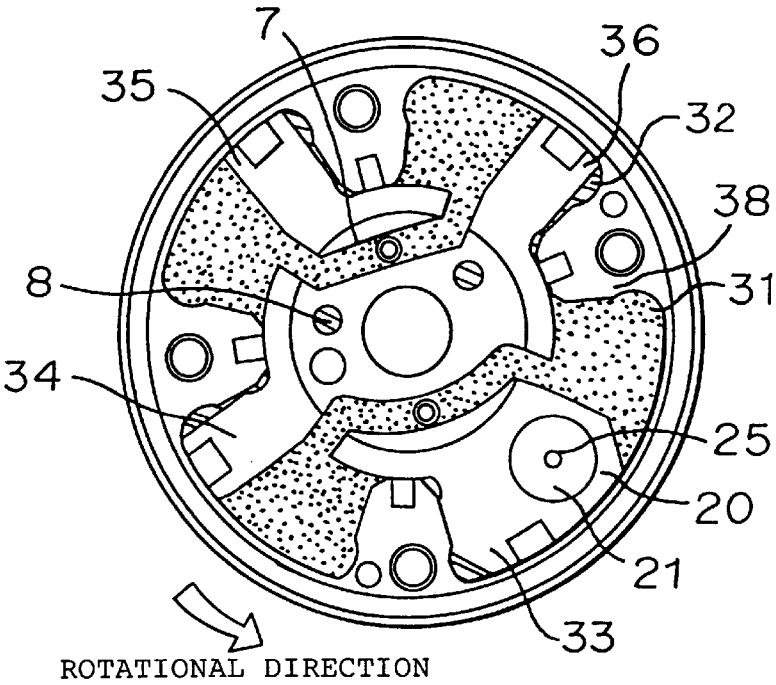
FIG. 8 is a schematic sectional view taken along Z—Z of FIG. 3 seen from an arrowed direction.

In FIG. 5 is shown a sectional view taken along X—X of FIG. 3 seen from the arrowed direction. In FIG. 6 is shown a schematic view of how a slide plate 40 moves. In FIG. 7 is shown a sectional view taken along Y—Y of FIG. 3 seen from the arrowed direction. In FIG. 8 is shown a sectional view taken along Z—Z of FIG. 3 seen from the arrowed direction. In these Figures, reference numeral 30 designates one of bolt holes which the bolts 15 are screwed in. Reference numeral 31 designates one of sector-shaped retarding hydraulic chambers which rotate first through fourth vanes 33–36 (explained later) in the retarding direction and which are surrounded by the rotor 20, the case 12, the cover 14 and the housing 11 so as to correspond to the first through fourth vanes 33–36. The retarding hydraulic chambers 31 communicate with the first oil passage 7 and are provided with the oil pressure through the first oil passage 7. Reference numeral 32 designates one of advancing hydraulic chambers which rotate the first through fourth vanes 33–36 in the advancing direction and which are surrounded by the rotor 20, the case 12 and the cover 14 and the housing 11 so as to correspond to the first through fourth vanes 33–36. The advancing hydraulic chambers 32 communicate with the second oil passage 8 and are provided with the oil pressure through the second oil passage 8. Depending on the oil pressure supplied to the advancing hydraulic chambers 32 and the retarding hydraulic chambers 31, the rotor 20 makes relative movement with respect to the housing 11 to change the volume of each of the hydraulic chambers. Reference numeral 33 designates the first vane which outwardly protrudes from the rotor 20, which has the holder 21 engaged in a portion thereof on the side of the housing 11, and which has a communicating oil passage 39 (explained later) recessed in a portion thereof on the side of the cover 14. The communicating oil passage 39 has a shifting groove 41 (explained later) recessed in a portion thereof, and the plunger oil passage 25 extends from the shifting groove 41 to the housing 11 through the holder 21.

Reference numerals 34–36 designates the second through fourth vanes, each of which outwardly protrudes from the rotor 20. Each of the first through fourth vanes has a chip seal 42 provided at a portion thereof contacting the case 12. Reference numeral 37 designates a vane supporter which forms a central portion of the rotor 20. Reference numeral 38 designates one of shoes which inwardly protrudes from the case 12 and which have the bolt holes 30 formed therein so as to receive the bolts 15. Each of the shoes has the chip seal 17 provided at a portion thereof contacting the vane supporter 17. Reference numeral 39 designates the communicating oil passage which extends between the advancing hydraulic chamber 32 and the retarding hydraulic chamber 31 on both sides of the first vane 33. Reference numeral 40 designates a slide plate which is movable in the shifting groove 41 (explained later) formed in the communicating oil passage 39, and which cuts off the communication between the advancing hydraulic chamber 32 and the retarding hydraulic chamber 31 so as to prevent oil leakage from occurring therebetween. When the oil pressure in the advancing hydraulic chamber 32 is higher, the slide plate 40 is moved toward the retarding hydraulic chamber 31 as shown in FIG. 6. When the oil pressure in the retarding hydraulic chamber 31 is higher, the slide plate is moved toward the advancing hydraulic chamber 32 as shown in FIG. 5.

Reference numeral 41 designates the shifting groove which is recessed in the communicating oil passage 39 and which has a portion thereof communicated with the plunger oil passage 25. When the slide plate 40 is moved toward the retarding hydraulic chamber 31 as shown in FIG. 6, the plunger oil passage 25 communicates with the advancing hydraulic chamber 32. When the slide plate 40 is moved toward the advancing hydraulic chamber 32 as shown in FIG. 5, the plunger oil passage 25 communicates with the retarding hydraulic chamber 31. Reference numeral 42 designates the chip seal which is provided with each of the first through fourth vanes 33–36 for sealing between each of the vanes and the case 12 to avoid oil leakage. The arrows in FIGS. 5, 7 and 8 indicate the rotational direction of the actuator 1 as a whole caused by e.g. the timing belt.

Now, the operation of the apparatus will be explained.

When the engine is standstill, the rotor 20 occupies a maximum retarding position (i.e. a position wherein the rotor is relatively rotated in the advancing direction at a maximum with respect to the housing) as shown in FIG. 5. In that case, the oil pressure which is supplied to the oil control valve 5 from the oil pump is low or atmospheric pressure, and the first and second oil passages 7 and 8 are not provided with the oil pressure, which means that the plunger oil passage 25 is not supplied with the oil pressure. As a result, the plunger 23 is pushed against the holder 21 by the urging force of the spring 24 to be engaged with the holder 21 as shown in FIG. 3.

When the engine starts, the oil pump operates to increase the oil pressure supplied to the oil control valve 5, supplying the oil pressure to the retarding hydraulic chamber 31 through the port B. At that time, the oil pressure in the retarding hydraulic chamber 31 closest to the first vane causes the slide plate 40 to move toward the advancing hydraulic chamber 32 closest to the first vane, establishing the communication with the retarding hydraulic chamber 31 and the plunger oil passage 25. As a result, the plunger 23 is pushed to be moved toward the housing 11, releasing the engagement between the plunger 23 and the rotor 20. Since the oil pressure is supplied to the retarding hydraulic chambers 31 in that time, the respective vanes 33–36 are contacted to and pushed against the respective shoes 38 in the retarding direction. Even if the engagement between the plunger 23 and the rotor is released, the housing 11 and the rotor 20 are pushed against each other by the oil pressure in the retarding hydraulic chambers 31, reducing or eliminating vibration or impact.

As explained, the plunger 23 can be moved using the oil pressure in the retarding hydraulic chamber 31 closest to the first vane. When the engine starts to produce a predetermined value of oil pressure (oil pressure enough to make the slide plate 40 and the plunger 23 move), the engagement between the plunger 23 and the rotor 20 can be released to take necessary action immediately when the rotor 20 is required to be advanced.

When the port A is opened in order to advance the rotor 20, the oil pressure is supplied to the advancing hydraulic chamber 32 through the second oil passage 8. The oil pressure is transmitted from the advancing hydraulic chamber 32 closest the first vane to the communicating passage 39 to push the slide plate 40 by the oil pressure, moving the slide plate toward the retarding hydraulic chamber 31 closest to the first vane. The movement of the slide plate 40 causes the plunger oil passage 25 to communicate with a portion of the communicating oil passage 39 on the side of the advancing hydraulic chamber 32, transmitting the oil pressure from the advancing hydraulic chamber 32 to the plunger oil passage 25. The transmitted oil pressure causes the plunger 23 to move toward the housing 21 against the urging force of the spring 24 so as to release the engagement between the plunger 23 and the holder 21 as shown in FIG. 4. While the engagement between the plunger 23 and the holder 21 is released, the amount of the supplied oil can be adjusted by the opening and closing operation of the ports B and A to control the oil pressure in the retarding hydraulic chambers 31 and the advancing hydraulic chambers 32, advancing and retarding the rotation of the rotor 20 with respect to the rotation of the housing 11. For example, the rotor is advanced at the maximum, the rotor rotates while the respective vanes 33–36 contact with the respective shoes 38 on the side of the retarding hydraulic chambers 31 as shown in FIG. 6. When the oil pressure in the retarding hydraulic chambers 31 becomes greater than that in the advancing hydraulic chambers 32, the rotor rotates in the retarding direction with respect to the housing 11. As explained, the oil pressure supplied to the retarding hydraulic chambers 31 and the advancing hydraulic chambers 32 can be controlled to carry out the retarding and advancing operation of the rotor 20 with respect to the housing 11.

The oil pressure supplied by the oil control valve 5 may be found by a CPU based on signals from a position sensor for detecting a relative rotational angle of the rotor 20 with respect to the housing 11 and from a crank angle sensor for determining a pressurizing amount by the oil pump in order to carry out feedback control.

Figure 9:
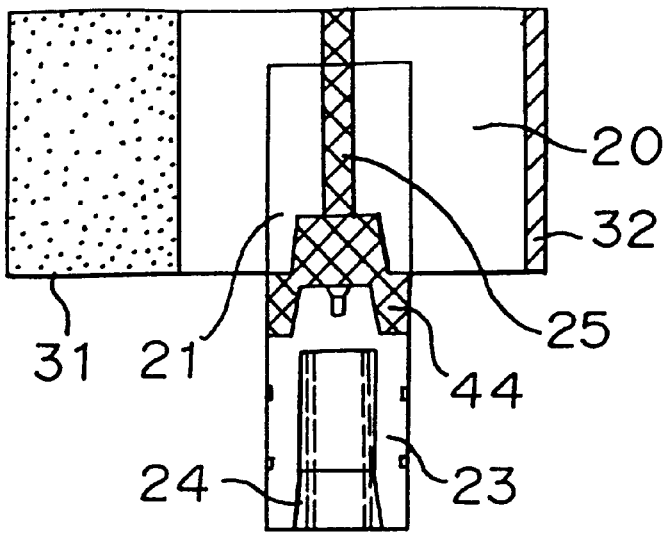
FIG. 9 is a schematic view showing a positional relationship between the plunger and the rotor according to the first embodiment.
Figure 10:
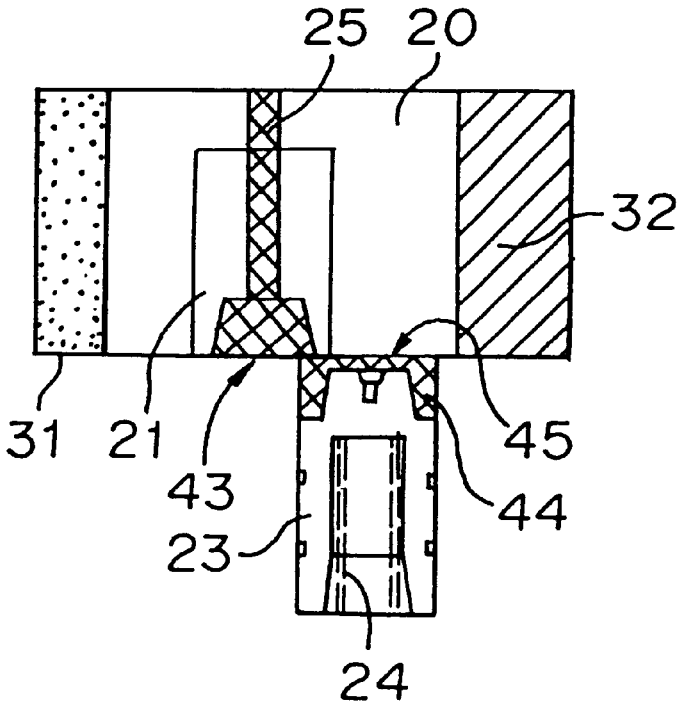
FIG. 10 is a schematic view showing a positional relationship between the plunger and the rotor according to the first embodiment.
Figure 11:
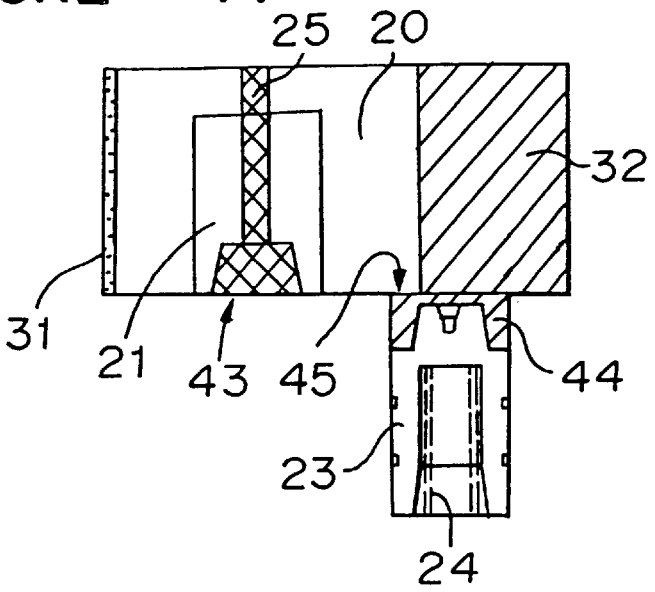
FIG. 11 is a schematic view showing a positional relationship between the plunger and the rotor according to the first embodiment.

Since the plunger oil passage 25 and the holder 21 are provided on the side of the rotor 20 while the plunger 23 is provided on the side of the housing 11, the positional relationship between the plunger oil passage 25 and the plunger 23 changes as the rotor 20 rotates with respect to the housing 11. When the rotor 20 occupies the maximum retarding position, the plunger 23 is pushed by the oil pressure from the plunger oil passage 25 as shown in FIG. 9. Although the position of the plunger 23 deviates from the position of the rotor as the rotor 20 rotates with respect to the housing 11, the plunger is continuously pushed by the oil pressure from the plunger oil passage 25 as long as the plunger oil passage 25 continues to have an opening 43 communicated with an opening 45 of a plunger housing portion 44 with the plunger 23 housed therein. When the rotor 20 further advances from this stage, a portion of the plunger 23 provided on the side of housing 11 is exposed to the advancing hydraulic chamber 32 to be pushed by the oil pressure in the advancing hydraulic chamber 32 as shown in FIG. 11.

In the first embodiment, the oil control valve 5 is formed in a spool valve type, and the spool in the oil control valve 5 is normally held at an initial position urged by a spring. When the spool is moved from the initial position, a solenoid which the oil control valve is formed with is energized to apply force to the spool in a direction against the urging force of the spring so as to carry out required movement. The oil control valve 5 is set so that the port B is opened at the initial position where the solenoid is deenergized, and the port A is opened when the solenoid is energized to move the spool. That is to say, when the solenoid is deenergized, the rotor moves toward the retarding side, and when the solenoid is energized, the rotor moves to the advancing side. Since the movement of the rotor to the retarding side occurs more frequently than that to the advancing side, frequently energizing of the solenoid becomes avoidable to decrease the frequency to flow a current in the solenoid, preventing the temperature of an electromagnet from rising and insulating coating from being broken.

EMBODIMENT 2

Figure 12:
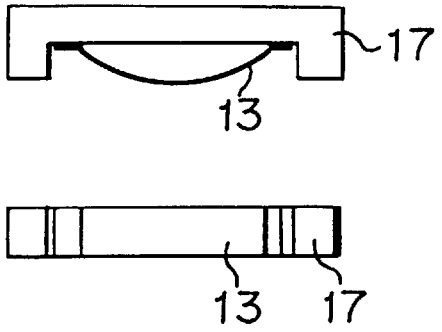
FIG. 12 is a front view and a bottom view showing the chip seal and the back spring according to the first embodiment.

In the first embodiment, the chip seals 17 are urged by the back springs 13 as shown in FIG. 2. Likewise, the chip seals 42 are urged by springs similar to the back springs 13. Since the back springs 13 are not fixed to the chip seals 17 as shown in FIG. 12, a back spring 13 could fall out of the chip seal 17 before assembling the chip seal with the back spring into the actuator 1. In such a case, attaching the back spring to the chip seal must be done again. If the chip seal with the back spring fallen out thereof is assembled into the actuator, the sealing property by the chip seal 17 lowers.

In FIGS. 13, 14, 15 and 16 are shown front views and bottom views of examples of the chip seal and the back spring according to a second embodiment.

Figure 13:
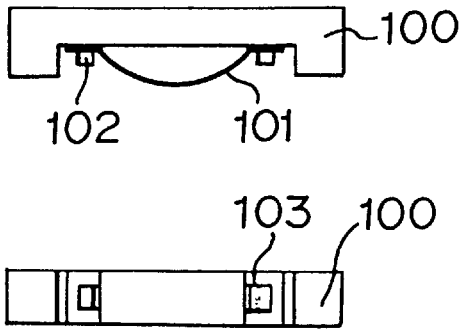
FIG. 13 is a front view and a bottom view showing a chip seal and a back spring according to a second embodiment of the present invention.

In FIG. 13, reference numeral 100 designates the chip seal, and reference numeral 101 designates the back spring which comprises a leaf spring formed in a circular arc. Reference numeral 102 designates one of convex portions which are formed on the chip seal 100 so as to project therefrom. Reference numeral 103 designates one of hooked holes which are formed on both ends of the back spring 101. When the convex portions 102 are inserted in and engaged with the hooked holes 103 in the back spring 101, the back spring 101 can be fixed to the chip seal 100 to prevent the back spring 101 from falling out of the chip seal 100 during assembling of the actuator 1.

Figure 14:
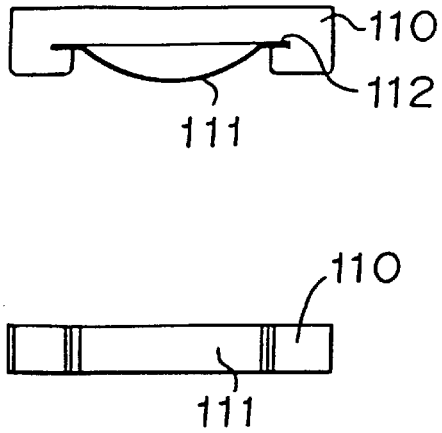
FIG. 14 is a front view and a bottom view showing a chip seal and a back spring according to the second embodiment.

In FIG. 14, reference numeral 110 designates another example of the chip seal, and reference numeral 111 designates another example of the back spring which comprises a leaf spring formed in a circular arc. Reference numeral 112 designates one of slits which are formed in the chip seal 110. When both ends of the back spring 111 are inserted into the slits, the back spring 101 can be fixed to the chip seal 100 to prevent the back spring 101 from falling out the chip seal 100 during assembling of the actuator 1.

Figure 15:
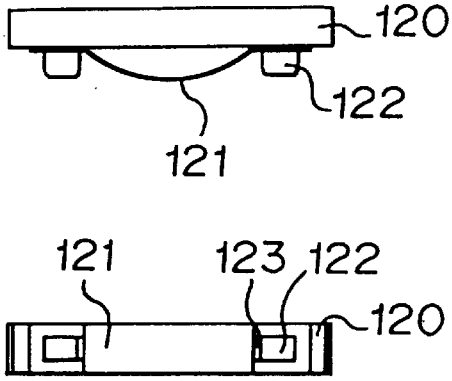
FIG. 15 is a front view and a bottom view showing a chip seal and a back spring according to the second embodiment.

In FIG. 15, reference numeral 120 designates another example of the chip seal, and reference numeral 121 designates another example of the back spring which comprises a leaf spring in a circular arc. Reference numeral 122 designates one of convex portions which are formed on the chip seal 120 so as to be projected therefrom. Reference numeral 123 designates one of hooked holes which are formed in both ends of the back spring 121. When the convex portions 122 are inserted in and engaged with the hooked holes 123 in the back spring 121, the back spring 121 can be fixed to the chip seal 120 to prevent the back spring 121 from falling out of the chip seal 120 during assembling of the actuator 1. In the chip seal 17 shown in FIG. 12, the chip seal 17 has both ends formed with convexed portions, and when the back spring 13 is deformed by force, the back spring contacts with the convex portions on both ends of the chip seal 17 to restrict amount of deformation in the back spring 13. In the chip seal 120 shown in FIG. 15, the restriction to the amount of deformation is borne by the convex portions 122.

Figure 16:
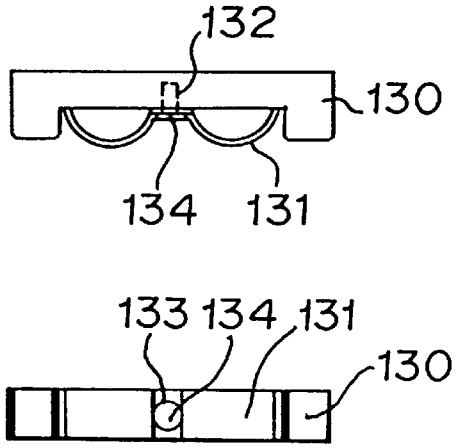
FIG. 16 is a front view and a bottom view showing a chip seal and a back spring according to the second embodiment.

In FIG. 16, reference numeral 130 designates another example of the chip seal, and reference numeral 131 designates another example of the back spring which comprises a wavy leaf spring with two circular arced portions coupled. Reference numeral 132 designates a machine screw hole which is formed in a recessed shape in the chip seal 130. Reference numeral 133 designates a machine screw hole which is formed in the portion of the back spring 131 with the two circular arced portions coupled thereat. Reference numeral 134 designates a machine screw which is inserted into the two machine screw holes 132 and 133. The machine screw 134 ensures the fixing of the back spring 131 to the chip seal 130 to prevent the back spring 131 from falling out of the chip seal 130 during assembling of the actuator 1.

EMBODIMENT 3

A third embodiment provides a modified example of the slide plate 40 which has a substantially rectangular shape in the first embodiment.

Figure 17:
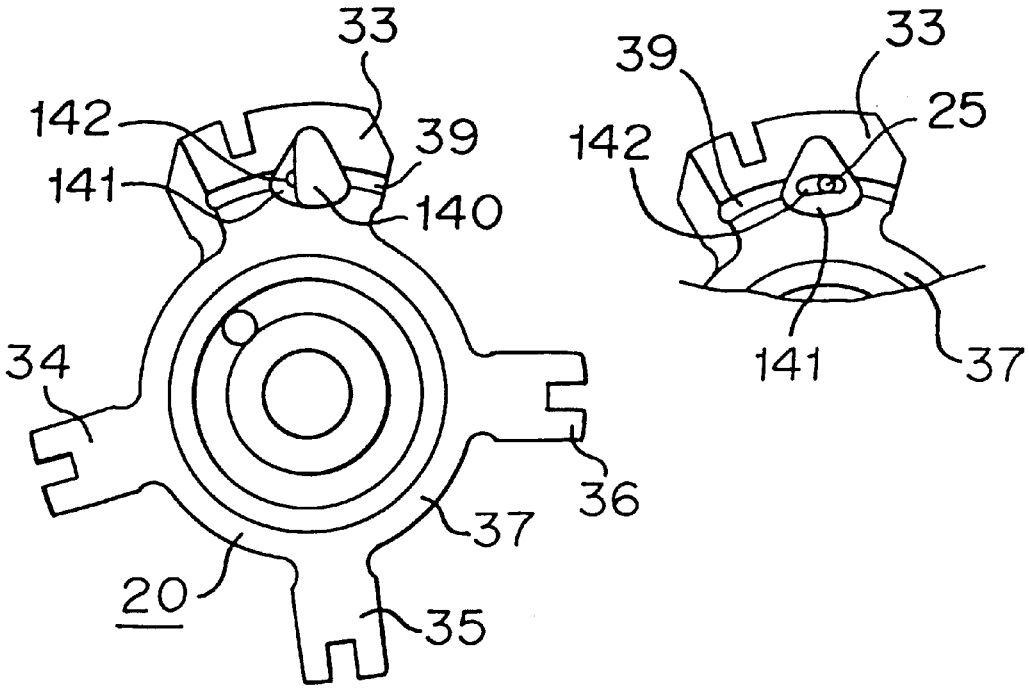
FIG. 17 is schematic views showing how the slide plate in a third embodiment of the present invention moves.
Figure 18:
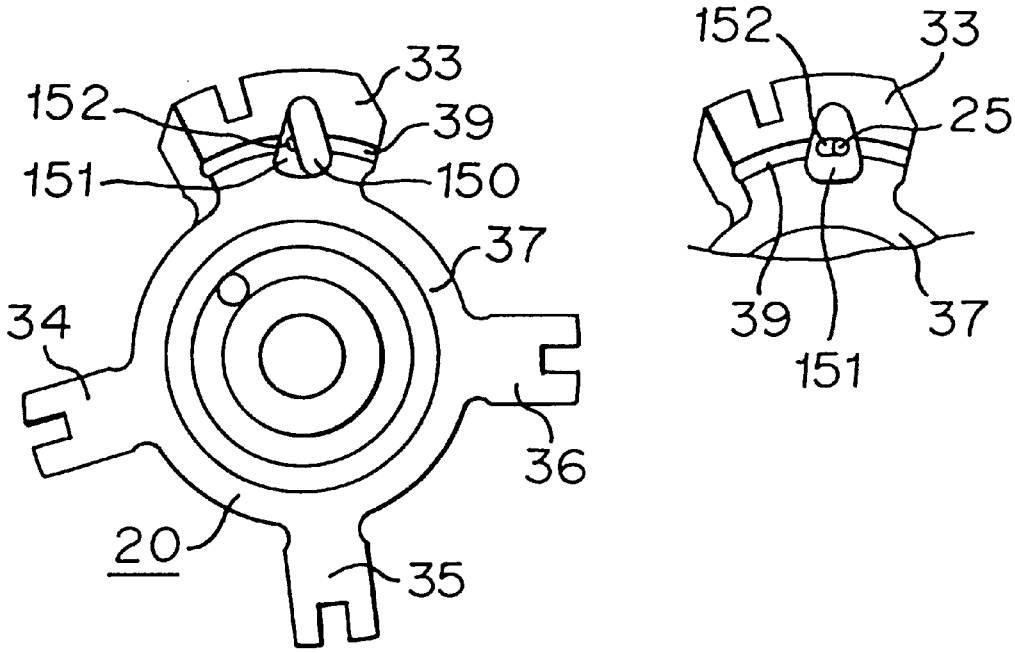
FIG. 18 is schematic views showing how the slide plate in a modified form according to the third embodiment moves.
Figure 19:
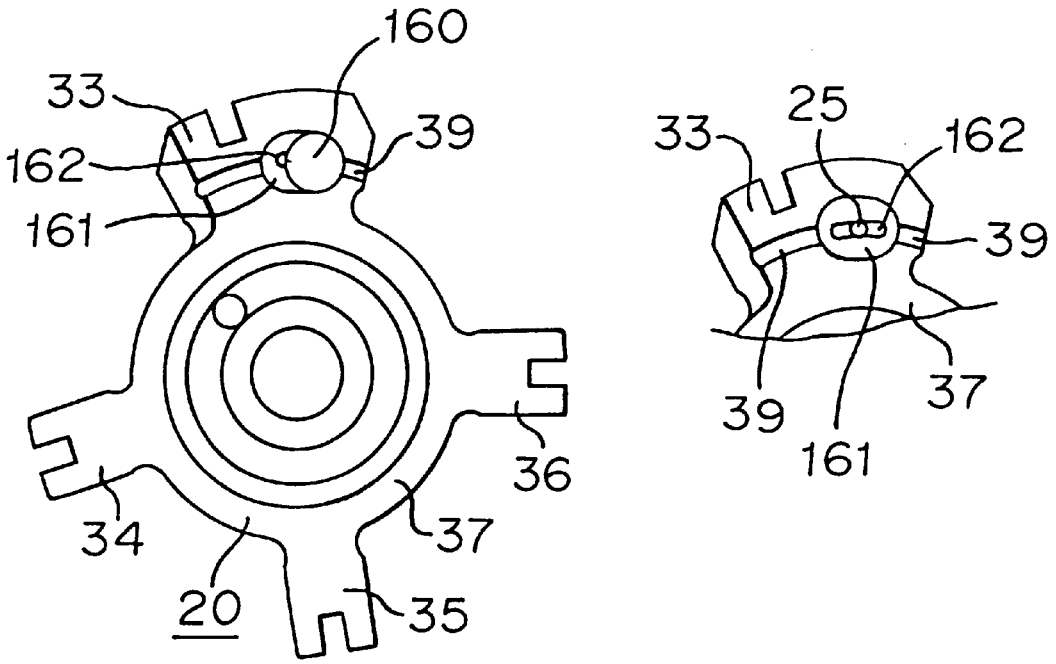
FIG. 19 is schematic views showing how the slide plate in a modified form according to the third embodiment moves.

In FIGS. 17, 18 and 19 are shown schematic views of examples of the rotor 20 according to the third embodiment.

In FIG. 17, reference numeral 140 designates an example of the slide plate which is sector-shaped. Reference numeral 141 designates a sector-shaped shifting groove which is provided so as to be recessed in a portion of the communicating oil passage and where the slide plate 140 is turnable and slidable in a predetermined angular range. Reference numeral 142 designates an opening groove which is provided so as to enlarge the opening area of the plunger oil passage 25. The slide plate 140 is turned in the shifting groove 141 under the oil pressure in the retarding hydraulic chamber 31 or the advancing hydraulic chamber 32 through the communicating oil passage 39. Depending on the rotational angle of the slide plate 140, the opening groove 141 opens to the retarding hydraulic chamber 31 or the advancing hydraulic chamber 32 and transmits the oil pressure in the plunger oil passage 25.

In FIG. 18, reference numeral 150 designates another example of the slide plate which has a substantially rectangular shape and rounded corners. Reference numeral 151 designates another example of the sector-shaped shifting groove which is provided so as to be recessed in a portion of the communicating oil passage 39 and where the slide plate 150 is turnable and slidable in a predetermined angular range. Reference numeral 152 designates another example of the opening groove which is provided so as to enlarge the opening area of the plunger oil passage 25. The slide plate 150 is turned in the shifting groove 151 under the oil pressure in the retarding hydraulic chamber 31 or the advancing hydraulic chamber 32 through the communicating oil passage 39. Depending on the rotational angle of the slide plate 150, the opening groove 152 opens to the retarding hydraulic chamber 31 or the advancing hydraulic chamber 32, and transmits the oil pressure to the plunger oil passage 25.

In FIG. 19, reference numeral 160 designates another example of the slide plate, which is formed in a circular shape. Reference numeral 161 designates another example of the shifting groove which is provided so as to be recessed in a portion of the communicating oil passage 39 and where the slide plate 160 can slidably shift in a predetermined range. Reference numeral 162 designates another example of the opening groove which is provided so as to enlarge the opening area of the plunger oil passage 25. The slide plate 160 can slidably shift in the shifting groove 161 under the oil pressure in the retarding hydraulic chamber 31 or the advancing hydraulic chamber 32 through the communicating oil passage 39. Depending on the shifting position of the slide plate 161, the opening groove 162 opens to the retarding hydraulic chamber 31 or the advancing hydraulic chamber 32, and transmits the oil pressure into the plunger oil passage 25.

EMBODIMENT 4

Although explanation of the oil passage communicating between the advancing and retarding oil passages in the respective embodiments has been made with respect to a case wherein the plunger is provided on the side of the housing, explanation of the oil passage communicating between the advancing and retarding oil passages according to a fourth embodiment will be made with respect to a case wherein the plunger is provided on the side of the rotor.

Figure 20:
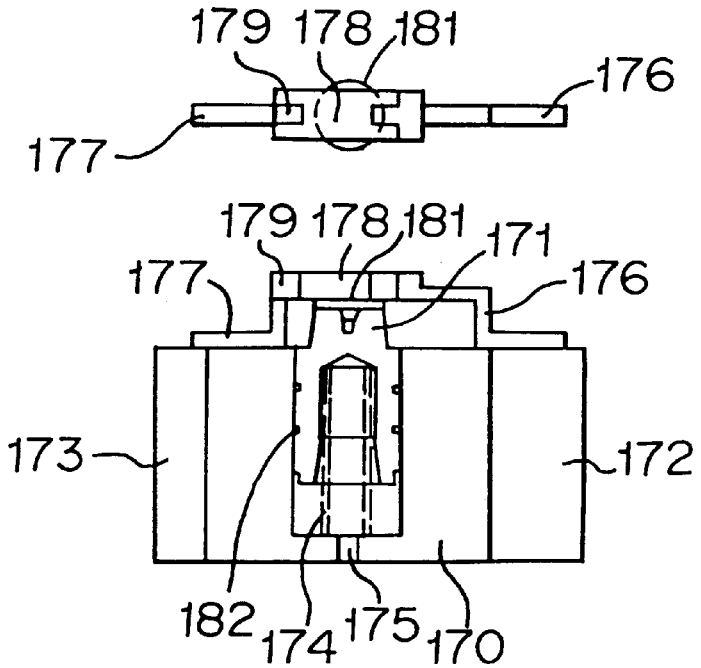
FIG. 20 is schematic views showing the plunger and its surroundings according to a fourth embodiment of the present invention.
Figure 21:
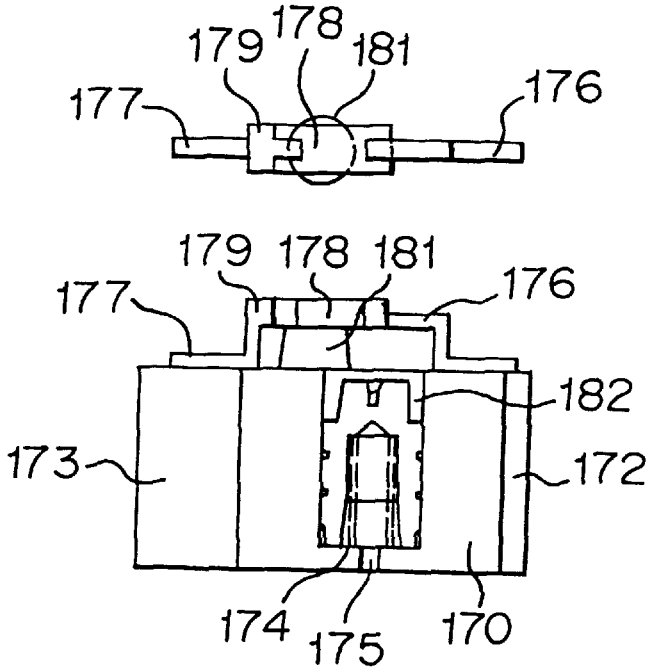
FIG. 21 is schematic views showing the plunger and its surroundings in a modified form according to the fourth embodiment.

In FIGS. 20 and 21 are shown schematic front views and schematic side views of the plunger and its surroundings according to the fourth embodiment. In these Figures, reference numeral 170 designates the rotor, reference numeral 171 designates the plunger, reference numeral 172 designates the retarding hydraulic chamber, reference numeral 173 designates the advancing hydraulic chamber, reference numeral 174 designates a spring, and reference numeral 175 designates an air hole. Reference numeral 176 designates a retarding side communicating passage which is formed in the housing. Reference numeral 177 designates an advancing side communicating passage which is formed in the housing. Reference numeral 178 designates a side plate, reference numeral 179 designates a shifting groove, reference numeral 181 designates a recessed portion which is formed in the housing, and reference numeral 182 designates a sliding hole which is formed in the rotor 170 and where the plunger 171 is slidable.

In FIG. 20, it is shown that the plunger 171 is engaged with the recessed portion 181 on the side of the housing. When the oil pressure is supplied to the retarding hydraulic chamber 172 or the advancing hydraulic chamber 173 in this state, the slide plate 178 is shifted in the shifting groove 179 through the retarding side communicating passage 176 or the advancing side communicating passage 177, establishing communication with the recessed portion 181. As a result, the plunger 171 is depressed against the urging force of the spring 174 to be disengaged from the recessed portion 181. After that, when the oil pressure is supplied to the advancing hydraulic chamber 173, the rotor 170 is relatively rotated with respect to the housing to occupy a position shown in FIG. 21.

Figure 22:
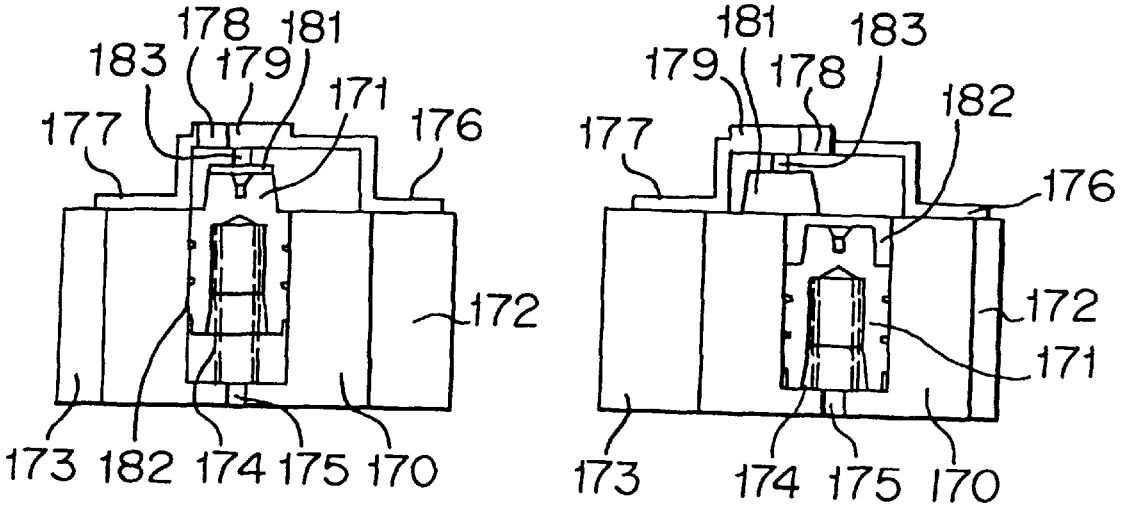
FIG. 22 is schematic views showing the plunger and its surroundings in a modified form according to the fourth embodiment.

In the fourth embodiment, if a plunger passage 183 is provided between the recessed portion 181 and the shifting groove 179 as shown in FIG. 22, the slide plate 178 can be reduced in size, and the shifting groove 179 can also reduce in size, making the housing smaller.

EMBODIMENT 5

Although the slide plate is provided on the side of the housing in the first embodiment, explanation of a fifth embodiment will be made with respect to a case wherein the slide plate is provided in the rotor 20.

Figure 23:
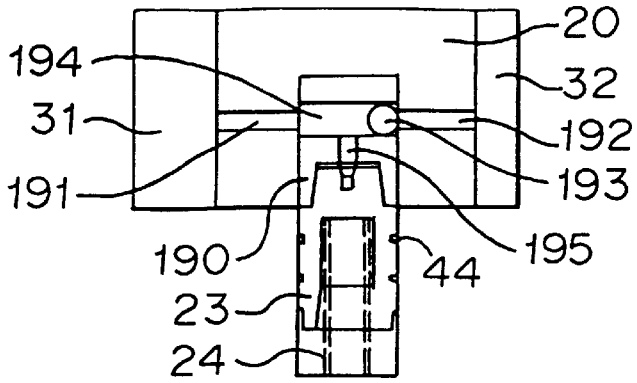
FIG. 23 is a schematic view showing the plunger and its surroundings according to a fifth embodiment of the present invention.
Figure 25:
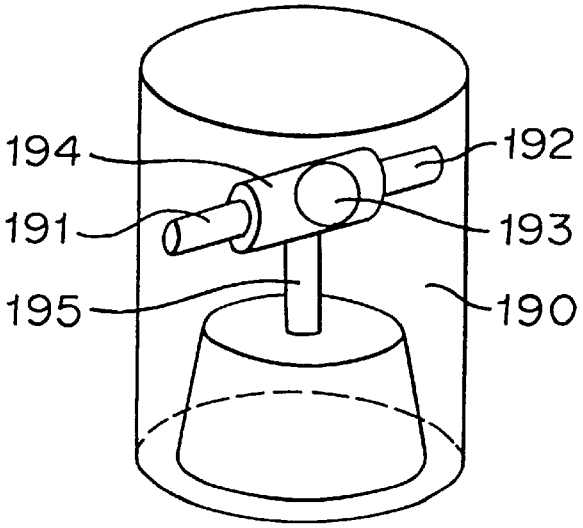
FIG. 25 is a schematic view showing the plunger and its surroundings in a modified form according to the fifth embodiment.

In FIGS. 23 and 25, reference numeral 190 designates a holder which is forced into the rotor 20, reference numeral 191 designates a retarding side communicating passage which communicates between the retarding hydraulic chamber 31 and the holder 190, reference numeral 192 designates an advancing side communicating passage which communicates between the advancing hydraulic chamber 32 and the holder 190, reference numeral 193 designates a spherical slide plate, reference numeral 194 designates a shifting chamber where the slide plate 193 is shiftable, and reference numeral 195 designates a plunger communicating passage which communicates between the shifting chamber 194 and the plunger housing portion 44.

When the oil pressure is supplied to the shifting chamber 194 from the advancing hydraulic chamber 32 or the retarding hydraulic chamber 31 through the advancing side communicating passage 192 or the retarding side communicating passage 191, the slide plate 193 is shifted in the shifting chamber 194 to communicate the plunger communicating passage 195 with the advancing hydraulic chamber 32 or the retarding hydraulic chamber 31, depressing the plunger 23 against the spring 24.

Figure 24:
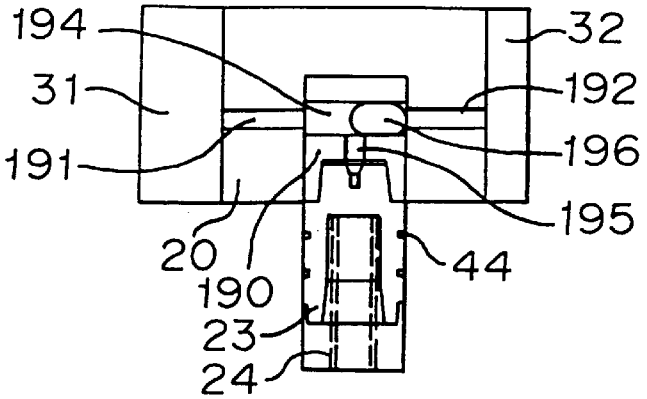
FIG. 24 is a schematic view showing the plunger and its surroundings in a modified form according to the fifth embodiment.

Although the slide plate is formed in a spherical shape in the fifth embodiment, the slide plate may have a cylindrical shape as shown in FIG. 24.

In accordance with the fifth embodiment, the slide plate can be housed in the rotor, making the apparatus smaller.

Although the rotor has four of the vanes in the respective embodiments, the number of the vanes may be 1 or more.

Although the pulley is fixed to the housing and the camshaft is fixed to the rotor in the respective embodiments, the pulley may be fixed to the rotor and the camshaft may be fixed to the housing.

Although explanation of the respective embodiments has been made with respect to the valve timing apparatus for adjusting the opening and closing timing of an intake valve, the present invention is also applicable to adjustment in the opening and closing timing of an exhaust valve.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic valve timing adjusting apparatus to be provided in a driving force transmission system for transmitting driving force to a camshaft with a cam for opening and closing an intake valve or an exhaust valve, comprising:

a housing assembly;

a rotor provided so as to be relatively rotatable with respect to said housing assembly;

an advancing hydraulic chamber and a retarding hydraulic chamber formed between said rotor and said housing assembly;

a convex member provided in one of said housing assembly and said rotor so as to be slidable therein;

a recessed portion provided in another one of said housing assembly and said rotor so as to be engageable with said convex member;

an urging member for urging said convex member toward said recessed portion; and an oil passage including a hydraulic switching device which is able to supply oil pressure from either one of said advancing hydraulic chamber and said retarding hydraulic chamber to said recessed portion;

wherein when said oil pressure is supplied to said advancing hydraulic chamber, said rotor is relatively rotated in an advancing direction with respect to said housing assembly, and when said oil pressure is supplied to said retarding hydraulic chamber, said rotor is relatively rotated in a retarding direction with respect to said housing assembly, and wherein when said oil pressure switched by said hydraulic switching device is supplied to said recessed portion, said convex member is slid in a direction opposite to said recessed portion to release engagement between the convex member and said recessed portion thereby enabling relative rotation of said housing assembly and said rotor in response to said oil pressure in said hydraulic chambers.

2. The apparatus according to claim 1, wherein the hydraulic switching device is provided in the rotor.

3. The apparatus according to claim 1, wherein the hydraulic chambers are constituted by an advancing hydraulic chamber and a retarding hydraulic chamber, the housing assembly has a housing portion recessed therein to slidably house the convex member, and the housing portion selectively communicates with one of the advancing hydraulic chamber and the retarding hydraulic chamber depending on the rotation of the rotor.

4. The apparatus according to Claim 1, wherein the hydraulic switching device is movable in a groove in a portion of a communicating oil passage communicating between the advancing hydraulic chamber and the retarding hydraulic chamber, and the hydraulic switching device includes a slide plate to carry out opening and closing operation of the oil passage for supplying the oil pressure to the recessed portion.

5. The apparatus according to claim 1, further comprising a seal member for preventing oil from moving between the hydraulic chambers, a leaf spring for urging the seal member toward a seal surface, and a holding member for holding the leaf spring so as to be deformable in a predetermined range.

6. The apparatus according to claim 1, further comprising a seal member for preventing oil from moving between the hydraulic chambers, a leaf spring for urging the seal member toward a seal surface, and a holding member for holding the leaf spring so as to be deformable in a predetermined range.

7. The apparatus according to claim 3, further comprising a seal member for preventing oil from moving between the hydraulic chambers, a leaf spring for urging the seal member toward a seal surface, and a holding member for holding the leaf spring so as to be deformable in a predetermined range.

8. The apparatus according to claim 4, further comprising a seal member for preventing oil from moving between the hydraulic chambers, a leaf spring for urging the seal member toward a seal surface, and a holding member for holding the leaf spring so as to be deformable in a predetermined range.

9. The apparatus according to claim 1, wherein the hydraulic switching device is at an end of the rotor.

10. A hydraulic valve timing adjusting apparatus to be provided in a driving force transmission system for transmitting driving force to a camshaft with a cam for opening and closing an intake valve or an exhaust valve, comprising:

a housing assembly;

a rotor provided so as to be relatively rotatable with respect to said housing assembly;

an advancing hydraulic chamber and a retarding hydraulic chamber formed between said rotor and said housing assembly;

a convex member provided in one of said housing assembly and said rotor so as to be slidable therein;

a recessed portion provided in another one of said housing assembly and said rotor so as to be engageable with said convex member;

an urging member for urging said convex member toward said recessed portion; and an oil passage including a hydraulic switching device which is able to supply oil pressure in either of said advancing hydraulic chamber and said retarding hydraulic chamber to said recessed portion;

wherein when said oil pressure is supplied to said advancing hydraulic chamber, said rotor is relatively rotated in an advancing direction with respect to said housing assembly, and when said oil pressure is supplied to said retarding hydraulic chamber, said rotor is relatively rotated in a retarding direction with respect to said housing assembly, wherein when said oil pressure switched by said hydraulic switching device is supplied to said recessed portion, said convex member is slid in a direction opposite to said recessed portion to release engagement between the convex member and said recessed portion thereby enabling relative rotation of said housing assembly and said rotor in response to said oil pressure in said hydraulic chambers, and wherein said hydraulic switching device is provided in the rotor.

11. The apparatus according to claim 10, wherein the hydraulic switching device is provided at an end of the rotor.

12. A hydraulic valve timing adjusting apparatus to be provided in a driving force transmission system for transmitting driving force to a camshaft with a cam for opening and closing an intake valve or an exhaust valve, comprising:

a housing assembly;

a rotor provided so as to be relatively rotatable with respect to said housing assembly;

an advancing hydraulic chamber and a retarding hydraulic chamber formed between said rotor and said housing assembly;

a convex member provided in one of said housing assembly and said rotor so as to be slidable therein;

a recessed portion provided in another one of said housing assembly and said rotor so as to be engageable with said convex member;

an urging member for urging said convex member toward said recessed portion; and an oil passage including a hydraulic switching device which is able to supply oil pressure in either one of an oil passage communicating with said advancing hydraulic chamber and an oil passage communicating with said retarding hydraulic chamber to said recessed portion;

wherein when said oil pressure is supplied to said advancing hydraulic chamber, said rotor is relatively rotated in an advancing direction with respect to said housing assembly, and when said oil pressure is supplied to said retarding hydraulic chamber, said rotor is relatively rotated in a retarding direction with respect to said housing assembly, wherein when said oil pressure switched by said hydraulic switching device is supplied to said recessed portion, said convex member is slid in a direction opposite to said recessed portion to release engagement between the convex member and said recessed portion thereby enabling relative rotation of said housing assembly and said rotor in response to said oil pressure in said hydraulic chambers, and wherein said hydraulic switching device is provided in the rotor.

13. The apparatus according to claim 12, wherein the hydraulic switching device is provided at an end of the rotor.

* * * * *